United States Patent [19]

Toho et al.

[11] Patent Number: 4,780,645

[45] Date of Patent: Oct. 25, 1988

[54] ELECTRONIC LIGHT RADIATION TUBE

[75] Inventors: Makoto Toho, Yahata; Koji Hiramatsu, Kadoma; Tadao Uetsuki, Osaka; Ryohei Itatani, Kyoto, all of Japan

[73] Assignee: Matsushita Electric Works, Ltd., Osaka, Japan

[21] Appl. No.: 948,003

[22] Filed: Dec. 31, 1986

[30] Foreign Application Priority Data

Jan. 14, 1986 [JP] Japan ..... 61-5207
May 26, 1986 [JP] Japan ..... 61-120608

[51] Int. Cl.[4] ..... H01J 63/00

[52] U.S. Cl. ..... 313/606; 313/161; 313/620; 313/629; 313/341; 315/344; 315/267

[58] Field of Search ..... 313/156, 161, 485, 492, 313/592, 608, 605, 606, 620; 315/344

[56] References Cited

U.S. PATENT DOCUMENTS 1,901,128 3/1933 Smith ..... 313/161
2,411,510 11/1946 Abadie ..... 313/161 X
4,069,416 1/1978 Suga ..... 313/161
4,341,979 7/1982 Gross et al. ..... 313/161 X
4,356,428 10/1982 Hanlet ..... 313/485
4,443,734 4/1984 Gross et al. ..... 313/161 X
4,516,057 5/1985 Proud et al. ..... 313/492 X
4,636,685 1/1987 Skeist et al. ..... 313/161 X

FOREIGN PATENT DOCUMENTS 054959 6/1982 European Pat. Off. ..... 313/485
61-19049 1/1986 Japan ..... 313/161

*Primary Examiner*—Leo H. Boudreau
*Assistant Examiner*—Mark R. Powell
*Attorney, Agent, or Firm*—Burns, Doane, Swecker & Mathis

[57] ABSTRACT

An electronic light radiation tube wherein a cathode and an anode disposed as spaced from each other by a small spacing are housed in an envelope enclosing therein a luminous gas, and a magnetic field is applied to the envelope so as to cause magnetic lines of force of the magnetic field to pass through the envelope, while the magnetic lines of force which have passed through the cathode are prevented from passing through the anode, whereby electrons emitted from the cathode are caused to collide at a high efficiency with the luminous gas throughout the entire interior space of the envelope to excite the gas, and highly uniform light radiation can be realized over the entire envelope.

11 Claims, 4 Drawing Sheets

ELECTRONIC LIGHT RADIATION TUBE

TECHNICAL BACKGROUND OF THE INVENTION

This invention relates to electronic light radiation tubes and, more particularly, to an electronic light radiation tube which ensures a highly efficient excitation radiation with a luminous gas enclosed in the tube under application of a static magnetic field for efficient collision of most of electrons with the gas, while maintaining the energy level of the electrons incident over a space for the radiation in the tube to be relatively low.

The electronic light radiation tube of the type referred to can be used as a fluorescent lamp comprising an envelope enclosing therein an ultraviolet-ray radiating gas and coated on the inner wall with fluorescent substance. Since such electronic tube can eliminate any need of such current limiting element as a stabilizer due to positive current-to-voltage characteristics as has been known, the electronic tube enables it possible to minimize the lamp in size and weight.

DISCLOSURE OF PRIOR ART

As an example of basic arrangement of such fluorescent lamp, there is disclosed an electric discharge lamp in U.S. Pat. No. 1,901,128 to Charles G. Smith, wherein a cathode is provided in a base of an envelope to be heated by a heating filament and an anode provided in its top with a plurality of apertures is disposed close to the cathode to surround the cathode. Also disclosed in European Patent Application No. 8254959 of J. M. Brand is a fluorescent lamp which is based on substantially the same principle as the U.S. patent.

In the known arrangement, an effective incidence of electrons over a relatively large space in the envelope on the other side of the anode than that of the cathode requires that any effect of spatial charge on the electrons is eliminated within the envelope, and the spatial charge effect is attempted to be eliminated by applying to the anode a voltage higher than the ionization potential of such luminous gas as mercury vapor enclosed in the envelope so as to attain within the envelope a plasma state. However, this arrangement still involves a problem that the high voltage application to the anode causes the energy level of the electrons within the relatively large space in the envelope to become much higher than that required for an effective excitation radiation, so as to reduce the luminous efficiency. When the envelope is made larger, further, there arises another problem that electrons do not reach the other end of the envelope than that of the cathode and the luminance becomes remarkably lower as the distance from the anode becomes larger.

In Japanese Patent Appln. Laid-Open Publication No. 19049/86 the inventors of which include one of the present inventors, Makoto Toho, there is suggested a device in which, in addition to the foregoing known arrangement, permanent magnets are disposed at both ends of the envelope so that their magnetic flux will pass through the envelope substantially in parallel to the axis of the envelope and electrons accelerated at the anode will be caused to move as if spirally wound on the respective magnetic lines of force. According to this earlier invention, it is attempted to achieve a uniform excitation radiation in the entire envelope by establishing a state in which the electrons are caused to be spirally turned about the magnetic lines of force and to be thereby shifted over the entire interior space of the envelope, to avoid any uneven radiation. In this earlier invention, however, the anode of a mesh electrode type is disposed as spaced from the cathode by a small spacing and to expand in normal relation to the axis of the envelope so that most part of the magnetic lines of force which have passed through the cathode will also pass through the anode, whereby the electrons moving along the magnetic lines of force are caused to pass through the anode or the proximity area thereto and substantially most of the electrons made incident over the radiation space are provided with a high energy level, so that, while effective radiation zone can be enlarged along the length of the magnetic lines of force, the luminous efficiency still has not been well improved. In this arrangement, further, it has been also defective in that the electrons are likely to be absorbed by the anode before incident over the radiation space so as to render not all of the emitted electrons to be contributive to the radiation. It has been thus a keen demand that the device will have a further improved luminous efficiency.

TECHNICAL FIELD OF THE INVENTION

A primary object of the present invention is, therefore, to provide an electronic light radiation tube wherein electrons emitted from a cathode can pass through an anode substantially without any obstacle and still can be maintained at a relatively low energy level, so that the probability of excitation with respect to luminous gas enclosed can be elevated and thus the luminous efficiency can be remarkably improved.

According to the present invention, the above object is attained by providing an electronic light radiation tube in which a cathode for emitting electrons and an anode disposed with respect to the cathode substantially at a position of the mean free path of the electrons are housed in a light transmitting envelope, and means for applying a magnetic field to the envelope to cause magnetic lines of force to pass through the envelope, the electrons being caused to collide at a high efficiency with a luminous gas enclosed in the envelope with an interposition of the magnetic lines of force for an excitation radiation of the gas, wherein most of the magnetic lines of force passed through the cathode are prevented from passing through the anode.

In the above arrangement, the electrons emitted from the anode are caused to pass through the anode preferably made in a ring shape, as converged to the central zone of the ring shape where the potential of the anode is low, the energy level of the electrons in a space on the other side of the anode than the cathode in the envelope is thereby lowered to be maintained at the one optimum for deriving an effective excitation radiation, the colliding movement of the electrons with the luminous gas with interposition of the magnetic lines of force can be further enhanced to realize the excitation radiation at a high luminous efficiency, and a substantially uniform radiation can be achieved throughout the entire envelope.

Other objects and advantages of the present invention shall be made clear from the following description of the invention detailed with reference to preferred embodiments shown in accompanying drawings.

Figure 1:
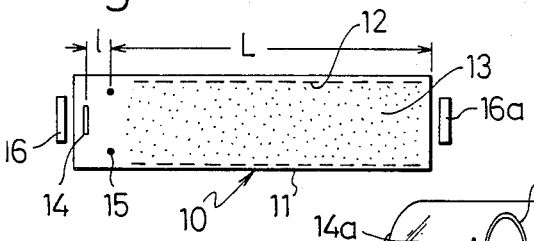
FIG. 1 is a schematic view of an embodiment of the electronic light radiating tube according to the present invention.

While the present invention shall now be described with reference to the preferred embodiments shown in the drawings, it should be understood that the intention is not to limit the invention only to the particular embodiments shown but rather to cover all alterations, modifications and equivalent arrangements possible within the scope of appended claims.

DISCLOSURE OF PREFERRED EMBODIMENTS

Figure 2:
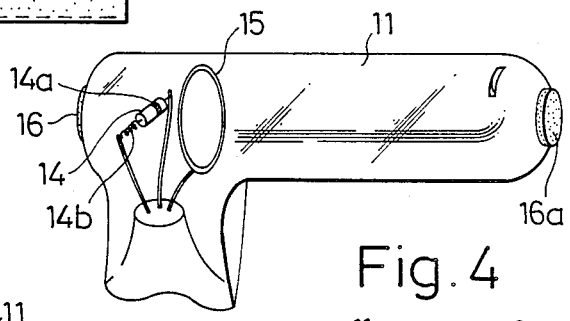
FIG. 2 is a perspective view in a rather practical form of the electronic tube of FIG. 1.

Referring to FIGS. 1 and 2, a tubular electronic light radiation device 10 usable as a fluorescent lamp comprises a gas-tight and light transmitting envelope 11 generally of a tubular shape and coated substantially over the entire inner wall surface with a fluorescent substance 12 and containing therein a very small amount of such luminous gas 13 as mercury vapor. In using the mercury vapor with respect to the envelope 11 having, for example, a length of about 100 mm and an outer diameter of 40 mm, the vapor is sealed therein by several milligrams. Cesium gas, sodium gas or the like may also be used as the luminous gas.

Inside and in the vicinity of one longitudinal end of the envelope 11, a cathode 14 carrying an emitter **14*a* and of, for example, an indirectly-heated type is provided for emission of electrons when heated by a heater 14*b* provided in a power feed line to the cathode. For heating the cathode 14, a heater filament may be disposed closely behind the cathode 14 on the side thereof facing the adjacent end of the envelope. An anode 15 is provided also within the envelope to closely oppose the cathode 14 as spaced by a distance in the order of the mean free path $\lambda$ of electrons emitted from the cathode 14. This anode 15 is formed in a ring shape and comprises for example, a nickel material. When the envelope 11 has an outer diameter of 40 mm, the ring-shaped anode should have a diameter of about 30 mm. In this case, the distance $\lambda$ between the cathode 14 and the anode 15 which substantially corresponds to the electron's mean free path $\lambda$ is set to be about 1 cm. A length L of a space in the envelope 11 extending from an opposite side of the anode 15 with respect to the envelope is set to largely exceed the mean free path $\lambda$. That length $\lambda$ could be for example, 8 cm for rendering the discharge from the cathode 14** to be of positive characteristics.

Outside both ends of the envelope 11, a pair of permanent magnets 16 and **16*a* are disposed to oppose each other with their opposite poles to produce a stationary magnetic field the magnetic lines of force of which pass through the tubular envelope 11 in its axial direction. When the envelope 11 and anode 15 are dimensioned to be, for example, as set forth in the foregoing, and the permanent magnets 16 and 16*a* produce the stationary magnetic field of about 300 gausses, there can be provided a magnetic field having such magnetic lines of force as shown by dotted lines in FIG. 3, which shown a convergence toward both ends of the envelope 11** with a Raman radius of electrons in the order of a fraction of 1 mm to several ten mm.

Figure 3:
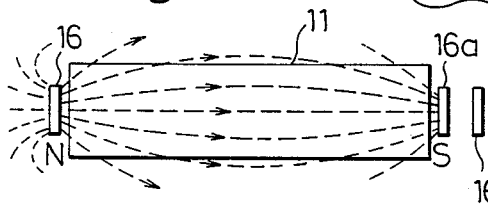
FIG. 3 is a diagram for explaining magnetic lines of force in the electronic tube of FIG. 1.
Figure 4:
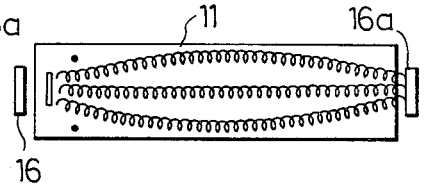
FIG. 4 is a diagram showing an example of moving loci of the electrons in the electronic tube of FIG. 1.

The operation of the electronic light radiation tube 10 according to the present invention will be explained. When the cathode 14 is heated by a suitable heating means and a voltage of, for example, about 30 V is applied between the cathode 14 and the anode 15, electrons are emitted from the cathode 14. Since the envelope 11 is here subjected to an electric field produced by the applied voltage and also to the stationary magnetic field having such magnetic lines force due to the permanent magnets 16 and **16*a* as shown in FIG. 3, electrons emitted from the cathode 14 are caused to spirally turn about the respective magnetic lines of force with the Raman radius of, for example, a fraction of 1 mm to several ten mm, in a manner of being trapped by the magnetic lines of force, as shown in FIG. 4. In this case, the emitted electrons will collide with atoms of such luminous gas 13 as mercury vapor in the envelope 11 to cause an excitation for the generation of ultraviolet rays, which rays are converted by the fluorescent substance 12 on the inner wall of the envelope 11 into visible rays to be radiated to the exterior of the envelope 11. Electrons collided with mercury vapor are to necessarily change their moving direction but are to ride on the nearest one of the magnetic lines of force to keep moving toward the end of the envelope 11 opposite to that having the cathode 14 and anode 15 again as spirally turned about the magnetic lines of force. Any electrons of which energy is lost due to the collision with the mercury gas or the like are again accelerated to move toward the opposite end of the envelope 11 as turned about the magnetic lines of force, due to the applied electric field in the envelope 11. Therefore, it will be appreciated that most electrons emitted from the cathode 14 are caused to move toward the opposite end of the envelope 11** as turned around or trapped by the respective magnetic lines of force while repeating the collision with the mercury vapor atoms.

Figure 5:
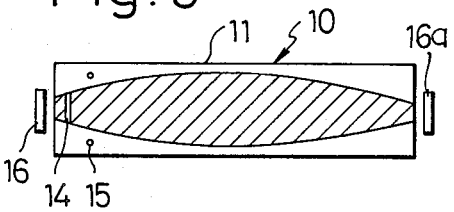
FIG. 5 is a diagram for explaining a luminous pattern in the electronic tube of FIG. 1.
Figure 6:
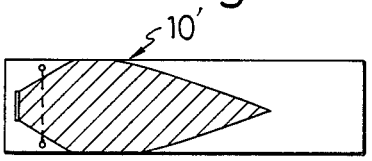
Fig. 6 PRIOR ART
FIG. 6 is a diagram for explaining a luminous pattern in a known electronic tube using a mesh electrode type anode but not using any means for applying a magnetic field, for comparision with FIG. 5.
Figure 7:
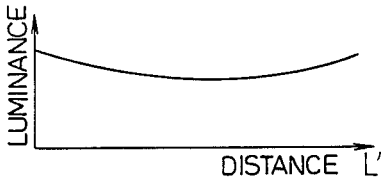
FIG. 7 is a graph showing a relationship between the distance from the anode and the luminance level.
Figure 8:
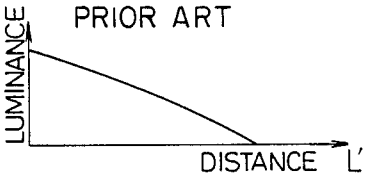
Fig. 8 PRIOR ART
FIG. 8 is a graph for explaining the luminous pattern of the known electronic tube of FIG. 6, for comparison with FIG. 7.

According to the electronic tube 10 of the present invention, therefore, there can be obtained such luminous pattern as shown as hatched in FIG. 5 in conformity to the distribution of magnetic lines of force of the stationary magnetic field and, as a comparison with such luminous pattern of an electronic light radiation tube 10' not subjected to any stationary magnetic field as shown in FIG. 6, an excellent excitation radiation of light can be realized all over the envelope 11. In other words, in the electronic tube 10 of the present invention, the luminance shown by a solid line curve in FIG. 7 is kept substantially constant even as the distance L' from the anode 15 increases, in contrast to that which is shown in FIG. 8 of an electronic tube not subjected to any stationary magnetic field and undesirably decreasing as the distance L' increases. Further, in the electronic tube 10 of the present invention, with an increase in the magnetic energy level of the stationary magnetic field, the respective magnetic lines of force are caused to be closer to the axis of the envelope 11 than those shown in FIG. 3, so that the electrons are thereby condensed toward the axis, and a luminous pattern high in the luminance along the axis of the envelope axis can be formed. When in particular the envelope 11 is of an elongated shape, the light radiation substantially uniform over the entire length of such elongated envelope can well be attained.

In the electronic tube 10 according to the present invention, in particular, the electrons emitted from the cathode 14 and moving along the magnetic lines of force as in the foregoing are prevented from being provided by the anode 15 with any high energy or being absorbed to the anode, since the anode 15 is formed in a ring shape and disposed to circumferentially enclose the axial line of the tubular envelope 11 so that the magnetic lines of force which have passed through the cathode 14 while extending in the axial direction of the envelope can be substantially prevented from passing through the ring-shaped anode 15. In a known arrangement where a mesh type anode is arranged normal to the axial direction of the envelope in which the magnetic field is applied, on the other hand, most of the magnetic lines of force are caused to pass through the material of both the cathode and anode so that most of the electrons emitted from the cathode and moving along the magnetic lines of force are provided with an energy higher than a level optimum for inducing excellent excitation radiation while some of the electrons are to be absorbed to the anode, and the luminance efficiency of this known arrangement has not been satisfactory.

Figure 9:
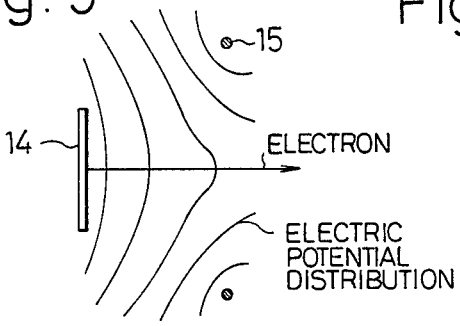
FIG. 9 is an explanatory graph for potential distribution in an area proximity to the both electrodes in the electronic tube employing the anode of FIG. 1.
Figure 10:
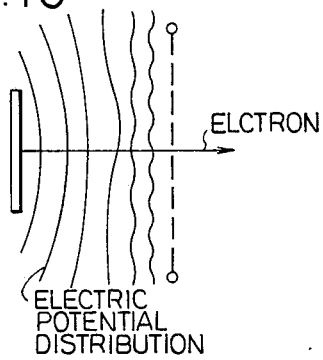
Fig. 10 PRIOR ART
FIG. 10 is an explanatory graph for potential distribution in the area proximity to the both electrodes in the electronic tube employing the anode of FIG. 6, for comparison with FIG. 9.
Figure 11:
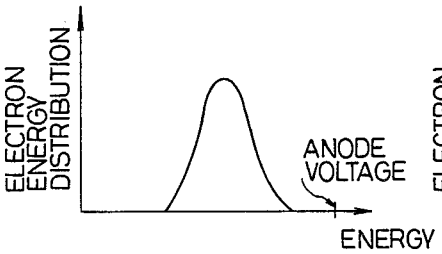
FIG. 11 is a graph showing energy distribution of the electrons in the radiation space of the electronic tube of FIG. 9.
Figure 12:
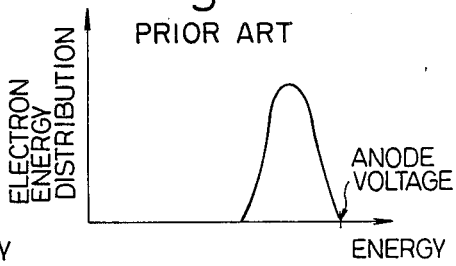
Fig. 12 PRIOR ART
FIG. 12 is a graph showing the energy distribution of the electrons in the radiation space in the case of the electronic tube of FIG. 10.

In the electronic tube 10 according to the present invention, the use of such ring-shaped anode 15 as in the foregoing is effective to provide a low potential area in the center of the ring shape of the anode 15 so that energy distribution of the electrons will be as shown by solid line curves in FIG. 9, quite in contrast to an event where a meshed anode is employed the energy distribution in which event is as shown in FIG. 10. When a stationary magnetic field is applied to this envelope 10, the electron energy is effectively caused to converge to the center of the ring-shaped anode 15 to be directed toward the opposite end of the envelope 11, the electrons are thereby effectively made to reach the radiation space in the envelope on the other side of the anode 15 opposite to the cathode 14 without being provided with any high energy upon passing through annular space of the ring-shaped anode 15, whereby the electron energy in the radiation space can be kept lower than the anode voltage as shown in FIG. 11 so as to be at a level suitable for the excitation radiation, and it is possible that the energy level in the radiation space is prevented from remarkably exceeding the suitable level, in contrast to any electronic tube employing any known anode is employed where the level is closer to the anode voltage as shown in FIG. 12. Further, since most of the same magnetic lines of force which have passed through the cathode are not to pass through the anode, the electrons moving as trapped by these magnetic lines of force are allowed to advance into the radiation space to be fully contributive to the excitation radiation, without being absorbed by the anode nor causing any dispersion loss with substantially most of these electrons.

Figure 13:
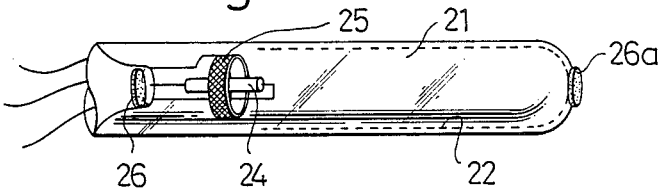
FIG. 13 is a perspective view of an electronic tube of another embodiment of the present invention.

Referring next to FIG. 13, there is shown another embodiment of the electronic light radiation tube according to the present invention, in which constituent elements substantially corresponding to those in the foregoing embodiment are denoted by the same reference numerals as in FIGS. 1 and 2 but added by 10. In the present embodiment, a tubular envelope 21 encloses therein a cathode 24 made in a rod shape and an anode 25 provided as a short cylindrical electrode, which are coaxially disposed closer to one of longitudinal ends of the envelope 31, with the cathode 24 positioned on the longitudinal axis of the envelope as surrounded partly by the anode 25 which also extends in the axial direction of the envelope, and a pair of permanent magnets 26 and **26*a* are positioned at the both ends of the envelope 21 to opposed each other with their opposite poles. While, in the present instance, electrons are emitted radially from the cathode 24 toward the anode 25, the stationary magnetic field applied to the envelope 21 by the magnets 26 and 26*a* with substantially the same magnetic lines of force as in FIG. 3 causes the emitted electrons driven toward the opposite end of the envelope 21 in a state of being trapped by the magnetic lines of force. With this arrangement, such possibility that the same magnetic line of force passes through both of the cathode 24 and anode 25** can be entirely eliminated and the luminous efficiency can be further improved. Other arrangement and operation are substantially the same as those in the foregoing embodiment.

Figure 14:
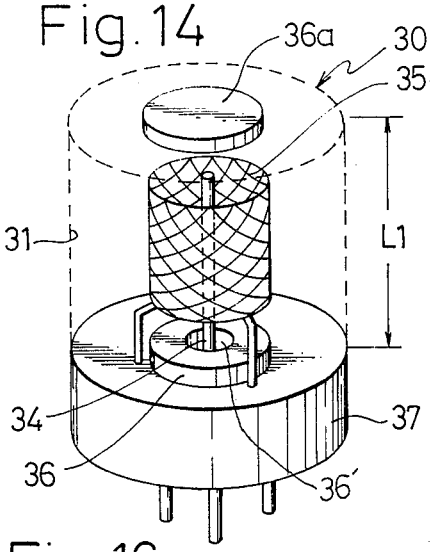
FIG. 14 is a schematic perspective view of an electronic tube of a further embodiment of the present invention.
Figure 15:
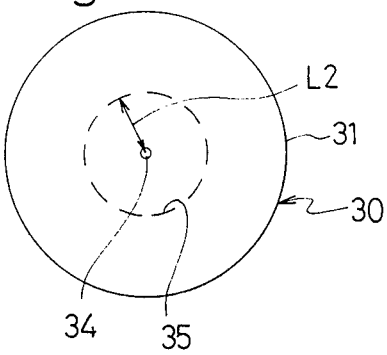
FIG. 15 is a schematic cross-sectional view of the electronic tube of FIG. 14.

According to another feature of the present invention, the arrangement for the high luminous efficiency can be also applied to an electronic light radiation tube comprising an envelope of a largely reduced length. There is shown in FIGS. 14 and 15 a major part of a further embodiment of the present invention, wherein constituent elements substantially corresponding to those in FIGS. 1 and 2 are denoted by the same reference numerals as in FIGS. 1 and 2 but added by 20. In the present embodiment, a bottomed cylindrical envelope 31 gas-tightly mounted at open end onto a base 37 as shown by dotted lines in FIG. 14 is made to have an extremely reduced length L1. In this envelope 31, a rod-shaped cathode 34 is disposed to extend substantially on the longitudinal axis of the envelope preferably over most of its length L1, and an anode 35 formed in a cylindrical electrode through which light can pass is provided to surround the cathode 34. This cylindrical anode 35 has an inner radius L2 for opposing the cathode 34 nearly at the spacing of the electron's mean free path λ, and is positioned to be coaxial with the cathode 34 to extend preferably over most of the extended length of the cathode 34 in the envelope 31. A pair of disk-shaped permanent magnets 36 and 36*a* are disposed respectively on the inner top surface of the base 37 and on the bottomed top surface of the envelope 31, to oppose each other with their opposite poles, while the magnet 36 on the top of the base 37 is provided in its center with a hole 36' for passing therethrough the cathode 34. Other arrangement in respect of the enclosed luminous gas in the envelope 31, the coating of fluorescent substance on the inner wall of the envelope 31, the application of the stationary magnetic field having magnetic lines of force along the axis of along the envelope and so on is substantially the same as that in the foregoing embodiments.

Figure 16:
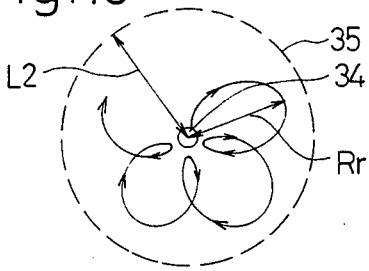
FIG. 16 is a diagram for schematically showing an example of moving electron locus in the electronic tube of FIG. 14.
Figure 17:
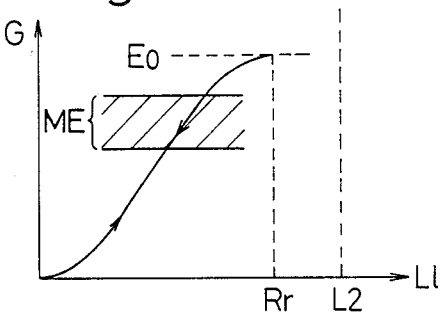
FIG. 17 is a graph for explaining an electron energy distribution in the electronic tube of FIG. 14.

When, in the present embodiment, the cathode 34 in the electronic light radiation tube 30 is heated and a voltage is applied between the cathode 34 and the anode 35 so that the anode 35 has a positive potential, electrons are emitted from the cathode 34 and accelerated to be directed to the anode 35. During the acceleration, these electrons are subjected to the stationaryd magnetic field having the magnetic lines of force lying in the axial direction of the envelope 31, that is, acting in normal direction to emitted direction of electrons, and are thus caused to draw such turning locus as shown in FIG. 16. In the present instance, the pressure of the luminous gas enclosed in the envelope 31 is so set as to render the electron's mean free path to be larger than the spacing between the cathode 34 and the anode 35 and, while the emitted electrons will have much less chance of colliding with atoms of the luminous gas so long as the electrons are made to turn only once, the magnitudes of the electric and magnetic fields applied to the envelope 31 are so set as to render the electron's turning radius, i.e., the Raman radius Rr to be slightly smaller than the distance L2 between the cathode 14 and the anode 15 ($L2 \leqq Rr$), so that the electrons will be turned many times while moving from the cathode 34 to the anode 35 to remarkably increase the chance of colliding with the luminous gas for a highly efficient excitation radiation of light. Accordingly, even the electrons which have lost their energy upon the collision are again accelerated and turned by the electric field, and the electrons which tend to return to the cathode 34 are not caught by the cathode 34 because of the negative potential of the cathode 34 but are rather again directed toward the anode 35. As a result, the emitted electrons are caused to collide with the luminous gas atoms while continuing to move as accelerated and decelerated in a state of being enclosed within the space between the cathode 34 and the anode 35. Thus the energy of the electrons varies every moment while moving between their extreme reach of the radius Rr and the cathode 34, but the maxium electron energy Eo is so set as to be slightly higher than the optimum exciting level band ME of the luminous gas so that a highly efficient excitation radiation of light can be thereby realized, as will be seen in a graph of FIG. 17 with the energy G taken on the ordinate and the distance Ll taken on the abscissa. Other operation of this embodiment is substantially the same as that of the foregoing embodiments.

Figure 18:
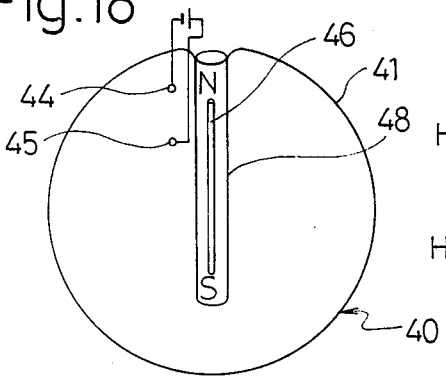
FIG. 18 is schematic view of an electronic tube of still another embodiment of the present invention.
Figure 19:
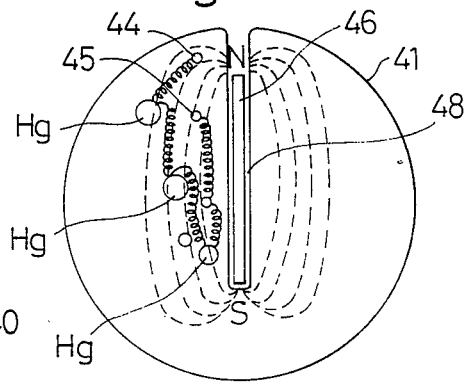
FIG. 19 is a diagram for explaining moving electron loci in the electronic tube of FIG. 18.

According to still another feature of the present invention, a space for accommodating the permanent magnet acting as means for generating the stationary magnetic field is secured within the lamp envelope while maintaining the highly efficient excitation radiation characteristics, for the simplicity of the appearance and the compactness of the tube. Referring to FIGS. 18 and 19 schematically showing an electronic light radiating bulb 40 as still another embodiment for this feature, substantially the same constituent elements as those in FIGS. 1 and 2 are denoted by the same reference numerals but added by 30. In the present embodiment, an envelope 41 of, for example, a spherical bulb shape is provided with a recess 48 which deeply extends substantially in a diametral direction of the envelope 41 to receive therein a rod-shaped permanent magnet 46 which is magnetized to be oppositely polarized at both longitudinal ends. A pair of cathode 44 and anode 45 of, for example, a ball shape are located within the envelope 41 at radially outward and inward positions relative to each other and close to the recess 48. In the present instance, the cathode 44 is disposed at the radially outward position and the anode 45 is at the radial inward position as spaced from the cathode 44 by a distance subtantially corresponding to the electron's mean free path. Further, the cathode 44 and anode 45 are located at such positions that the same one or ones of the magnetic lines of force of the permanent magnet 46 which are describing arcuate paths with respect to the diametral direction of the envelope 41 will not pass through the cathode and anode. Other arrangement is substantially the same as that of the foregoing embodiments.

In the present embodiment, as the cathode 44 of the electronic light radiation tube 40 is heated and a voltage is applied between the cathode 44 and the anode 45 so that the anode 45 has a positive potential, electrons are emitted from the cathode 44 toward the anode 45. Under this condition, the emitted electrons are subjected to a stationary magnetic field having magnetic lines of force curved arcuately withd respect to the diametral direction of the envelope 41, and the electrons are caused to move as trapped by such magnetic lines of force. The thus moved electrons are then caused to collide with atoms of such luminous gas as mercury gas Hg enclosed in the envelope 41 to be contributive to the excitation radiation. Any electron which has lost its energy upon collision with Hg atoms and thereby repelled toward another magnetic line of force will be again accelerated by the particular line of force so as to again collide with the Hg atoms. This operation is repeated and the magnetic lines of force are passed through the entire interior of the envelope 41. As a result, the emitted electrons can be caused to collide with the Hg atoms substantially in the entire interior space of the envelope 41 for the highly efficient excitation radiation.

Figure 20:
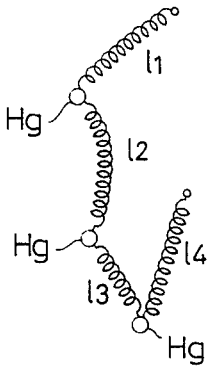
FIG. 20 is a diagram showing a more practical example of the moving electron loci of FIG. 19.

Assuming now that an electron takes such loci as shown, for example, in FIG. 20 of l1→l2→l3→l4 while spirally turning and repetitively colliding with three Hg atoms as emitted from the cathode 44 and before reaching the anode 45, the electron energy is expressed by the following equation:

$$\int_{l1} E\,dl + \int_{l2} E\,dl + \int_{l3} E\,dl + \int_{l4} E\,dl = eVa$$

wherein E is the intensity of the electric field and Va is the potential of the anode. It will be appreciated from the above equation that the energy which the electron obtains before the collision with the luminous gas atom is set to be considerably lower than the anode potential and to be at the optimum energy level for the excitation radiation, and the luminous efficiency can be effectively improved. Other operation is substantially the same as that of the foregoing embodiments.

Figure 21:
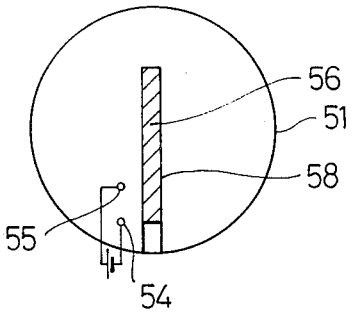
Figure 22:
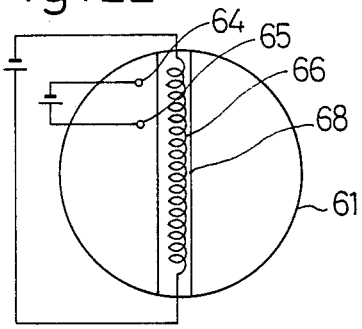
Figure 23:
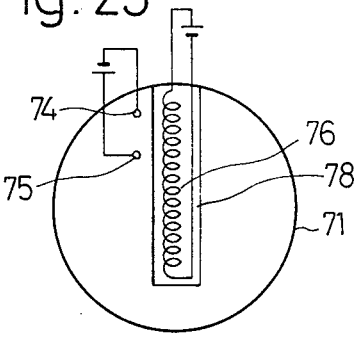
Figure 24:
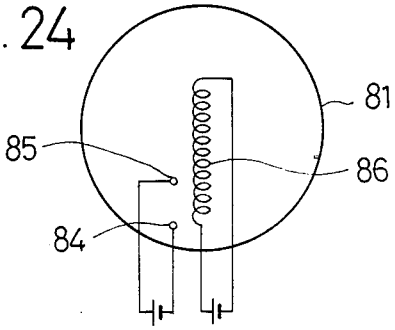

While in the embodiment of FIGS. 18 and 19 the recess 48 has been shown to be opened at one end in the surface of the envelope 41, the recess may be provided, as in FIG. 21, as a recess 58 closed at both ends within an envelope 51. Further, the means for generating the magnetic field as housed in the envelope is not limited to the permanent magnet but may be an electromagnet. As shown in FIG. 22, for example, an envelope 61 of a bulb shape may be provided with a diametral through-hole 68, in which an electromagnet 66 is inserted. In this case, as shown in FIG. 23, an electromagnet 76 may be housed in a recess 78 made in and envelope 71 to extend in its diametral direction as opened at one end or, as shown in FIG. 24, an electromagnet 86 may even be provided as directly enclosed within an envelope 81.

Other arrangements of the respective embodiments of FIGS. 21 to 24 are substantially the same as in the embodiment of FIGS. 18 and 19 and substantially the same operation can be attained.

Figure 25:
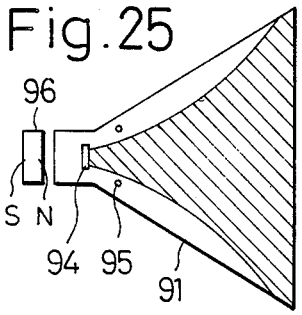
FIGS. 21 to 26 are schematic diagrams of electronic tubes of other different embodiments of the present invention, respectively.
Figure 26:
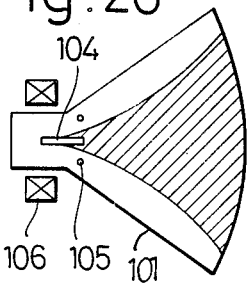

In the electronic light radiation tube according to the present invention, various design modifications are possible. While in the embodiment of FIGS. 1 and 2 or of FIG. 14 the permanent magnets are provided in a pair at both longitudinal ends of the tubular envelope, it is possible, for example, to provide a single permanent magnet 96 at a constricted base end part of a tube 91 of a funnel shape as shown in FIG. 25, while a cathode 94 and a ring-shaped anode 95 are disposed inside the tube to be closer to the base end part, for applying the stationary magnetic field the magnetic lines of force of which will expand from the base end part through the ring-shaped anode 95 toward the other expanded end of the tube 91. It will be also appreciated that the application of the magnetic field is not limited only to be by means of the permanent magnet here but, as shown in FIG. 26, a single electromagnet 106 may be employed therefore, substantially nwith the same arrangement as in FIG. 25 with respect to a similar funnel-shaped envelope.

What is claimed as our invention is:

1. An electronic light radiation tube comprising a light-transmitting envelope enclosing therein a luminous gas, a cathode provided in said envelope for emitting electrons, an anode provided in said envelope and spaced from said cathode by a distance corresponding substantially to the mean free path of said electrons and whereby said electrons pass through and are accelerated by said anode, means for applying a magnetic field to said envelope so as to cause magnetic lines of force of said magnetic field to pass through the envelope, wherein said cathode, anode, and magnetic means being mutually positioned such that said magnetic lines of force of said magnetic field applied are effective to guide said electrons through said anode whereby said electrons are collided at a hign efficiency with said luminous gas in said envelope with interposition of said magnetic lines of force for an excitation radiation.

2. An electronic tube according to claim 1, wherein said envelope is coated on its inner wall with flourescent substance, and said luminous gas is mercury vapor.

3. An electronic tube according to claim 1, wherein said envelope is of an elongated cylinderical shape, and said cathode and anode are disposed in one longitudinal end part of said elongated envelope.

4. An electronic tube according to claim 3, wherein said anode is of a ring shape, and said magnetic-field applying means comprises a pair of magnets disposed at both longitudinal ends of said envelpe as opposed to each other with opposite poles.

5. An electronic tube according to claim 1, wherein said anode is of a ring shape, and said magnetic-field applying means comprises a magnet provided at an end of said envelope.

6. An electronic tube according to claim 3, wherein said cathode is of a rod shape and disposed to extend in longitudinal axial direction of said elongated envelope, said anode comprises a cylindrical electrode disposed to surround part of said cathode while extending in said axial direction of the envelope, and said magnetic-field applying means comprises magnets disposed at both longitudinal ends of the envelope.

7. An electronic tube according to claim 3, wherein said cathode is of a rod shape and disposed to extend in longitudinal axial direction of said elongated envelope, said anode comprises a cylindrical electrode disposed to surround part of said cathode while extending in said axial direction of the envelope, and said magnetic-field applying means comprises a magnet disposed at a longitudinal end of the envelope.

8. An electronic tube according to claim 1, wherein said envelope is provided in the form of a cylinder having a relatively short axial length, said cathode is provided in the form of a rod and disposed to extend longitudinally in axial direction of said envelope, said anode is a cylindrical electrode which is disposed to extend along most part of said cathode in said axial direction of the envelope to be coaxial with said cathode, and said magnetic-field applying means comprises magnets disposed at both axial ends of said envelope as opposed to each other with opposite poles.

9. An electronic tube according to claim 1, wherein said envelope is of a spherical shape, said magnetic-field applying means is provided diametrally in said spherical envelope, and said cathode and anode are disposed close to said magnetic-field applying means in an outer peripheral zone in the envelope.

10. An electronic tube according to claim 1, wherein said magnetic-field applying means is a permanent magnet.

11. An electronic tube according to claim 1, wherein said magnetic-field applying means is an electromagnet.

* * * * *